United States Patent [19]

Vanmaele et al.

[11] Patent Number: 4,777,124

[45] Date of Patent: Oct. 11, 1988

[54] AZO DYE COMPOUNDS FOR USE IN A DYE DIFFUSION TRANSFER PROCESS AND PHOTOGRAPHIC ELEMENTS INCORPORATING THEM

[75] Inventors: Luc J. Vanmaele, Gent; Christian C. Van de Sande, Belsele; Wilhelmus Janssens, Aarschot, all of Belgium; Hans Vetter, Cologne, Fed. Rep. of Germany

[73] Assignee: Agfa-Gevaert, N.V., Mortsel, Belgium

[21] Appl. No.: 16,100

[22] Filed: Feb. 18, 1987

[30] Foreign Application Priority Data

Feb. 28, 1986 [EP] European Pat. Off. ..... 86200313.4

[51] Int. Cl.[4] ..... G03C 5/54; G03C 7/26

[52] U.S. Cl. ..... 430/562; 430/222; 430/223; 430/561

[58] Field of Search ..... 430/223, 562, 561, 563, 430/222

[56] References Cited

U.S. PATENT DOCUMENTS

| | | | |
|---|---|---|---|
| 4,242,435 | 12/1980 | Poschel et al. | 430/223 |
| 4,529,692 | 7/1985 | Ono et al. | 430/223 |
| 4,605,613 | 8/1986 | Van de Sande et al. | 430/223 |
| 4,663,273 | 5/1987 | Van de Sande et al. | 430/223 |

*Primary Examiner*—Richard L. Schilling

*Attorney, Agent, or Firm*—A. W. Breiner

[57] ABSTRACT

A ballasted non-diffusing compound that is capable of releasing a diffusible particularly light-fast azo dye from a non-diffusible carrier moiety, wherein said compound contains not more than two aromatic nuclei between said carrier moiety and a dye part that remaining linked to said aromatic nuclei is releasable by redox-reaction and wherein at least one of said aromatic nuclei is substituted with a $R^4SO_2NH$— group as defined.

6 Claims, No Drawings

AZO DYE COMPOUNDS FOR USE IN A DYE DIFFUSION TRANSFER PROCESS AND PHOTOGRAPHIC ELEMENTS INCORPORATING THEM

The present invention relates to organic compounds for use in a dye diffusion transfer process and photographic elements incorporating them. Important non-conventional multicolour reproduction systems are based on dye diffusion transfer processing. These systems are of particular value for reasons of simplicity of processing and rapidity of access to the colour image.

Dye diffusion transfer imaging can be carried out in a number of ways but each system is based on the same principle, namely the alteration of the solubility of dyes controlled by the development of the photographic silver image.

In commonly known dye diffusion transfer processes the dye-image-producing compounds are (A) initially mobile in alkaline aqueous media and become immobilized during processing, or (B) they are initially immobile and are mobilized during processing.

A survey of such processes is given by Christian C. Van de Sande in Angew. Chem. Int. Ed. Engl. 22 (1983) 191–209.

Known compounds for use in a dye diffusion transfer process include e.g. triphenylmethane, xanthene, azo, azomethine, anthraquinone, alizarine, merocyanine, quinoline or cyanine dye structures. Of particularly frequent use is a mono-azo-dye group (ref. e.g. U.S. Pat. No. 3,725,062).

Redox-controlled dye-releasing compounds are introduced in commercial systems and are known from various sources.

Oxidizable dye-releasing compounds that after oxidation release a dye moiety by hydrolysis are known, e.g., from DE-A No. 2,242,762, DE-A No. 2,406,664, DE-A No. 2,505,246, DE-A No. 2,613,005, DE-A No. 2,645,656 (DE-A stands for German Auslegeschrift) and Research Disclosure publications Nos. 15,157 (November 1976), 16,654 (April 1977) and 17,736 (January 1979).

In these references dye-releasing compounds are described in which the dye moiety is linked most frequently to an oxidizable carrier moiety through a sulphonamido group. The dye released from such compounds contains a sulphamoyl group.

Oxidizable dye-releasing compounds which in oxidized form release a dye moiety by intromolecular displacement reaction are described, e.g., in U.S. Pat. No. 3,443,940. The dye released from these compounds contains a sulphinate group.

It is particularly interesting in dye diffusion transfer to operate with dye-releasing compounds the dye release from which is inversely proportional to the development of a negative-working silver halide emulsion layer and whereby positive dye images can be formed in a receptor material.

Oxidizable dye-releasing compounds that in oxidized form are stable but in reduced state set free a dye moiety by an elimination reaction are described in DE-A No. 2,823,159 and DE-A No. 2,854,946. Compounds of that type when used in reduced form in an unexposed silver halide emulsion material are called IHO-compounds wherein IHO is the acronym for "inhibited hydrolysis by oxidation". When used in the oxidized form these compounds are called IHR-compounds, wherein IHR is the acronym for "increased hydrolysis by reduction".

Reducible quinonoid IHR-compounds which after reduction can undergo a dye release with an intermolecular nucleophilic displacement reaction are described in DE-A No. 2,809,716 wherein these compounds are called BEND-compounds, BEND standing for "Ballasted Electron-accepting Nucleophilic Displacement".

Reducible IHR-compounds which after reduction can undergo a dye release with an elimination reaction are described in the published EP-A No. 0,004,399 and in the U.S. Pat. No. 4,371,604.

Other classes of compounds that may release a dye after reduction are described in DE-A No. 3,008,588 and DE-A No. 3,014,669.

Particularly useful are redox-controlled dye-releasing compounds according to the general formula:

BAL-REDOX-DYE wherein:

BAL represents a moiety with ballast residue for immobilizing the dye-releasing compound in a hydrophilic colloid layer, REDOX represents a redox-active group, i.e. a group that under the circumstances of alkaline silver halide development is oxidizable or reducible and depending on the oxidized or reduced state yields a dye release by an elimination reaction, nucleophilic displacement reaction, hydrolysis or cleavage reaction, DYE represents a diffusible dye moiety or a precursor thereof.

It is a requirement that the dyes forming the photographic image have a sufficient stability against visible light. Azo dyes belong to the group of dyes that have a favourable stability in that respect but improvements are still desirable.

Stability against light of azo dyes has been improved by forming complex-compounds with metal ions as described e.g. in U.S. Pat. Nos. 4,207,104 and 4,357,412. The metal ions can be present in the image-receiving layer itself or in a layer adjacent thereto, or the image-receiving layer can be contacted with metal ions in a bath after diffusion of the dye has taken place. Metal ions suited for complexing with particular azo dyes are polyvalent metal ions such as copper(II), zinc(II), nickel(II), cobalt (II), platinum(II) or palladium(II). The use of said ions adds to the cost of the imaging system and makes it ecologically less attractive.

It is one of the objects of the present invention to provide new compounds for use in a photographic dye diffusion transfer process wherein said compounds yield dye images with improved stability against light without need for complexing polyvalent metal ions.

It is more particularly one of the objects of the present invention to provide new compounds that are capable of releasing a diffusible azo dye in function of a redox-reaction taking place in the development of a silver halide emulsion layer under alkaline conditions, and that have an improved stability against light by the presence in the releasable dye part of a special non-chromophoric organic group.

It is another object of the present invention to provide a photographic silver halide emulsion material incorporating said compounds in ballasted, i.e. non-diffusing state for image-wise release of a diffusible azo dye in a dye-diffusion transfer process.

In accordance with the present invention ballasted non-diffusing compounds are provided that are capable of releasing a diffusible azo dye from a carrier moiety by a redox-reaction which compounds correspond to the following general formula:

CAR-L-G-D wherein:

CAR represents a ballasted carrier moiety making said compound non-diffusing in a hydrophilic colloid medium under wet alkaline conditions, e.g. a hydroquinone type or quinone type residue examples of which are described hereinafter, L represents a chemical group cleavable or releasable from the carrier moiety by a redox-reaction or argentolytic reaction taking place in dependence on and in function of the development of a silver halide emulsion layer under alkaline conditions, G represents a bivalent organic linking group or a further substituted bivalent organic linking group, said group containing one or two aromatic nuclei, e.g. phenylene nuclei, D is an azo dye part chemically linked to a said aromatic nucleus of G, characterized in that at least one of said aromatic nuclei of G is substituted with a $R^4SO_2NH$-group, wherein $R^4$ is an alkyl group, e.g. methyl group, or substituted alkyl group, e.g. aralkyl group, an aryl group, e.g. phenyl group, or substituted aryl group.

L is —O—, —S—, —$SO_2$—, —$NR^1SO_2$—, —$NR^1CO$—, —$NR^1$— or a —$N^+R^1R^2$—.($X^-$) group, wherein $R^1$ and $R^2$ (same or different when being both present) is hydrogen, an alkyl group, a substituted alkyl group, an aryl group or a substituted aryl group, and $X^-$ is an anion.

$G^1$, and $G^2$ (same or different) is a chemical bond or a bivalent linking atom or group, e.g. —O—, —S—, —$SO_2$—, —$CH_2$—, —$CH_2CH_2$—, —$NR^3$—, —$OCH_2CH_2O$—, —$OCH_2CH_2$—, —$CONR^3$—, $SO_2NR^3$—, —$NR^3CO$—, —$NR^3SO_2$—, wherein $R^3$ is hydrogen, an alkyl group, a substituted alkyl group, an aryl group or a substituted aryl group, and $R_i$ and $R_j$ (same or different) is hydrogen or one or more substituents, e.g. halogen, an alkyl group, a substituted alkyl group, alkoxy, alkylthio, a $R^4CONH$— group, a $R^4SO_2NH$— group, wherein $R^4$ is an alkyl group, e.g. methyl group, or substituted alkyl group, e.g. aralkyl group, an aryl group, e.g. phenyl group, or substituted aryl group, with the proviso that at least one of the groups $R_i$ and $R_j$ is the group $R^4SO_2NH$—, m and n (same or different) is zero or 1, 2, 3 or 4, with the proviso that the two of them are not zero at the same time, and x and y (same or different) is zero or 1, with the proviso that not both of them are zero at the same time, and D is an azo dye part chemically linked to a $G^1$ or $G^2$.

Preferred dye releasing compounds are within the scope of the following general formulae (II) and (III):

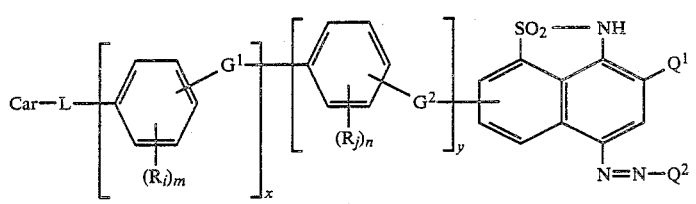

(II)

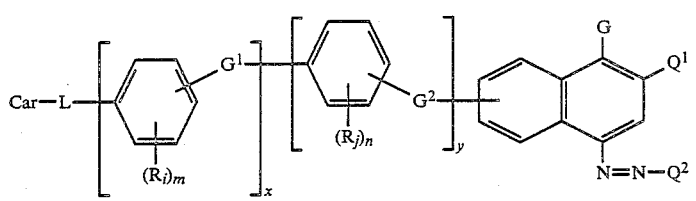

(III)

Particularly useful compounds according to the present invention correspond to the following general formula (I):

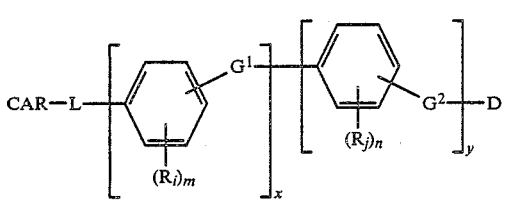

(I)

wherein:

CAR represents a ballasted carrier moiety making said compound non-diffusing in a hydrophilic colloid medium under wet alkaline conditions, e.g. a hydroquinone type or quinone type residue examples of which are described hereinafter, wherein:

G: OH or hydrolysable precursor thereof, —$NH_2$, —$NHSO_2R^{10}$, —$NHCOR^{10}$ wherein $R^{10}$ has the same meaning as $R^1$, $Q^1$: hydrogen, $SO_3H$, $CO_2H$, hydrolysable derivatives thereof or salts thereof, —$CONR^{11}R^{12}$, —$SO_2NR^{11}R^{12}$, —$COR^{13}$, or —$SO_2R^{13}$ with the proviso that $R^{11}$ and $R^{12}$ have one of the meanings given for $R^3$ and together may form a heterocyclic ring and that $R^{13}$ has one of the meanings given for $R^3$.

$Q^2$: aryl or substituted aryl group; a heterocyclic aromatic group or a substituted heterocyclic group such as e.g. a 2-thiazolyl-group and its substituted derivatives, a 2-(1,3,4-)thiadiazolyl group and its substituted derivatives, a 2-benzthiazolyl group, and wherein all the other symbols have the meaning described above in general formula (I) but $G^2$ is present in general formula (II) in the 5, 6 or 7-position of the naphthalene nucleus and in general formula (III) in the 5, 6, 7 or 8-position of the naphthalene nucleus carrying —N=N—$Q^2$ in the 4-position.

Examples of carrier moieties including the group L, i.e. (CAR-L-), wherefrom in oxidized form a dye moiety is split off are given hereinafter.

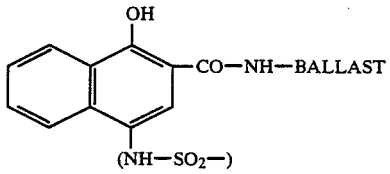

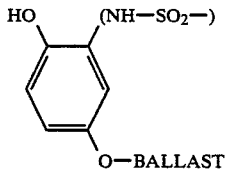

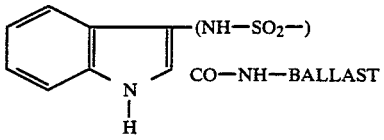

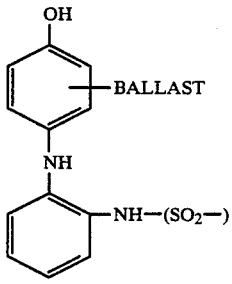

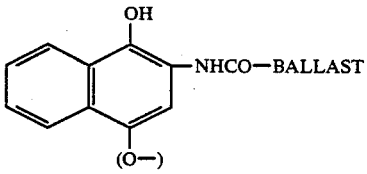

The groups within brackets are released together with the dye moiety (not represented), and remain as diffusion promoting groups with the dye moiety.

In the above mentioned dye-releasing compounds the dye release proceeds directly proportional to the rate of formation of the oxidation products of developing agent used in the development of silver halide. Said compounds are therefore negative working in that they undergo dye release in correspondence with the exposed portions of a negative working silver halide emulsion layer. For the production of positive pictures an image reversal is needed which may be based on the use of positive-working layers containing a direct-positive silver halide emulsion or on the silver salt complex diffusion transfer process by selecting a proper layer assemblage as described, e.g., in published EP-A 0,003,376.

Examples of carrier moieties including the group L, i.e. (CAR-L-), wherefrom in reduced state a dye moiety can be set free are the following:

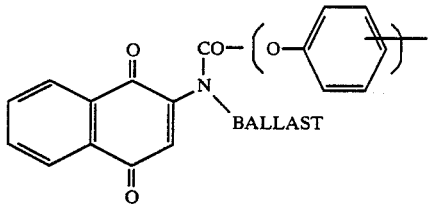

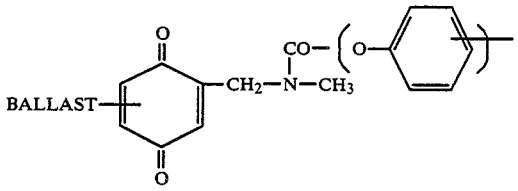

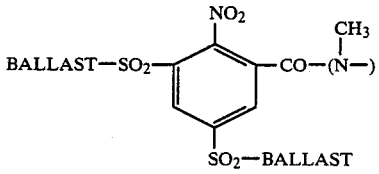

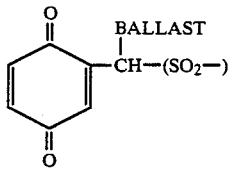

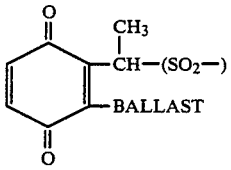

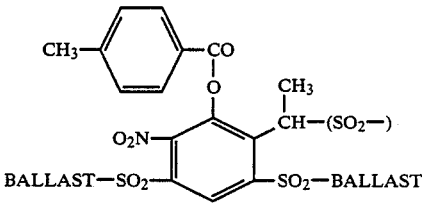

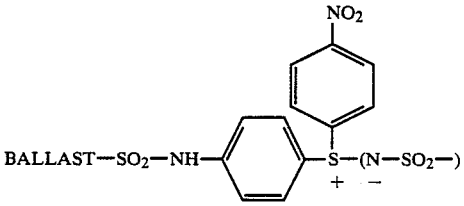

Examples of carriers which can release dyes by argentolysis are described in the already mentioned Angew. Chem. Int. Ed. Engl. 22 (1983) p. 207. Representatives of such carriers are e.g.:

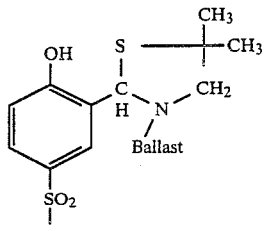

and

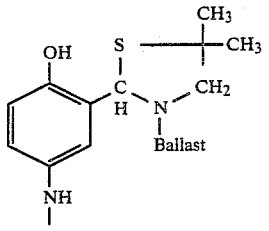

The groups within brackets are functional groups that are split off together with the dye moiety (not shown). These functional groups can be separated from the chromophoric group of the dye by a linking member having no influence on the absorption properties of the dye. The functional group, however, optionally together with said linking member, may be of importance to determine the diffusion-mobility and/or capability of the released dye to be mordanted. Useful linking members are, e.g., alkylene and arylene groups.

Ballast residues (BALLAST) that confer diffusion resistance are residues which allow the compounds according to the invention to be incorporated in a non-diffusing form in the hydrophilic colloids normally used in photographic materials. Organic residues, which generally carry straight- or branched-chain aliphatic groups and also isocyclic or heterocylic or aromatic groups mostly having from 8 to 20 carbon atoms are preferred for this purpose. These residues are attached to the remainder of the molecule either directly or indirectly, e.g. through one of the following groups: —NH-CO—; —$NHSO_2$—; —NR—, in which R represents hydrogen or alkyl; —O—; —S—; or —$SO_2$—. The residue which confers diffusion resistance may in addition carry groups which confer solubility in water, e.g. sulpho groups or carboxyl groups, and these may also be present in anionic form. Since the diffusion properties depend on the molecular size of the compound as a whole, it is sufficient in some cases, e.g., if the entire molecule is large enough, to use one or more shorter-chain groups as groups conferring resistance to diffusion.

In a preferred embodiment for positive dye image production with negative working silver halide emulsions the above groups D form part of the already mentioned dye releasing quinonoid IHR-compounds wherefrom a diffusible dye moiety is released by reduction and hydrolysis.

The reaction operative in the release of a dye moiety from said quinonoid IHR-compounds proceeds in two stages (A) and (B) illustrated by the following equations:

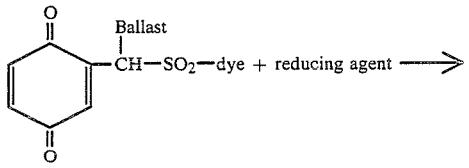

(I)

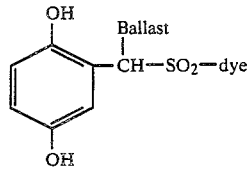

(II)

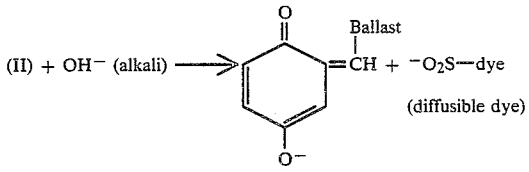

wherein:

"Ballast" stands for a ballasting group making the compound non-diffusing in a hydrophilic colloid medium under wet alkaline conditions.

The terminology "diffusing" in this invention denotes materials having the property of diffusing effectively through the colloid layers of the photographic elements in alkaline liquid medium. "Mobile" has the same meaning. The term "non-diffusing" has the converse meaning.

Particularly suited carrier groups (CAR) correspond to the following structural formulae listed in Table 1.

TABLE 1

CAR 1

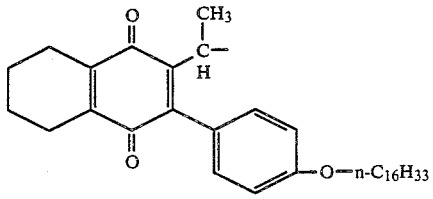

CAR 2

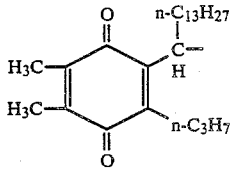

These carrier groups and other particularly useful carrier groups are described in published EP-A Nos. 0 004 399, 0 038 092, 0 109 701 and in U.S. Pat. No. 4,273,855.

Particularly suited dye parts D correspond to the following structural formulae listed in Table 2.

TABLE 2
| No. | Structural formula of D | Type of compound |
|---|---|---|
| C1 | 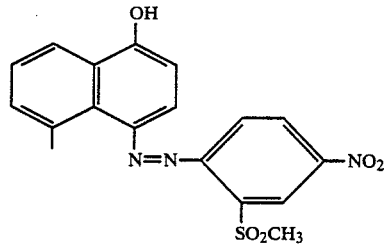 | cyan dye residue |
| Y1 | 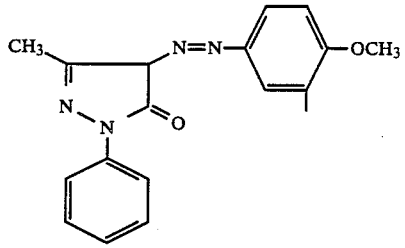 | yellow dye residue |
| Y2 | 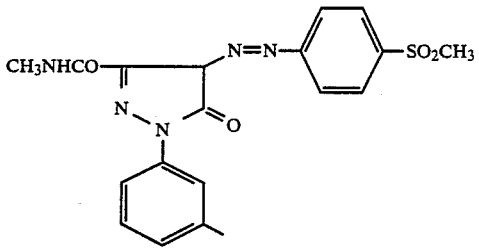 | yellow dye residue |
| M1 | 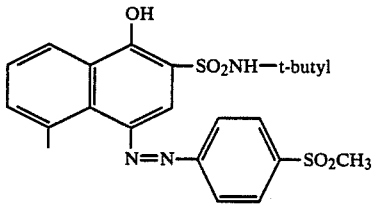 | magenta dye residue |
| C2 | 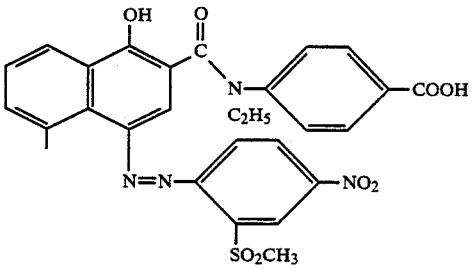 | cyan dye residue |
| C3 | 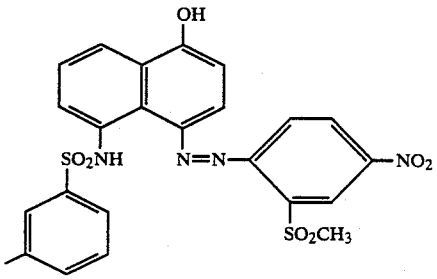 | cyan dye residue |

TABLE 2-continued

| No. | Structural formula of D | Type of compound |
|---|---|---|
| M2 | 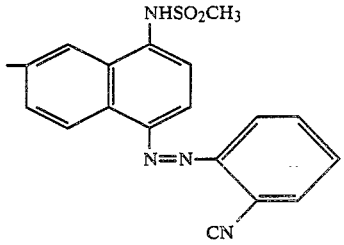 | magenta dye residue |

Other suitable dye parts are disclosed in EP No. 0121930.

For the synthesis of compounds containing such dye part groups D reference is made to e.g. U.S. Nos. 3,929,760, 3,954,476, 4,225,708, 4,256,831, and EP No. 4399.

Examples of mono-azo dye IHR-compounds for use according to the present invention and being within the scope of general formula (I) are listed in the following Tables 3 and 4.

TABLE 3

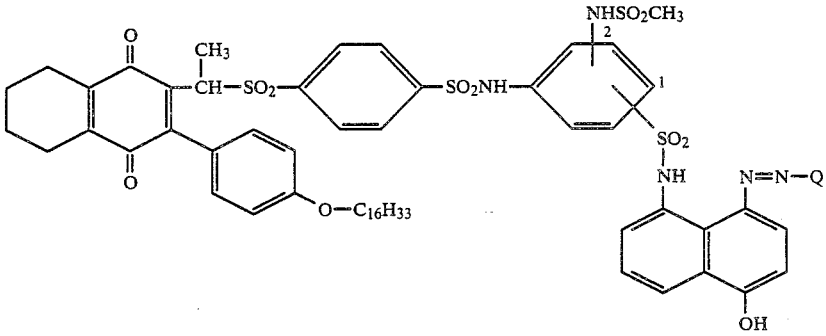

| No. | $-NHSO_2CH_3$ position | $-SO_2NH-$ position | $Z^1$ | $Z^2$ | Q |
|---|---|---|---|---|---|
| 1 | 2 | 1 | $-NO_2$ | $-SO_2CH_3$ | 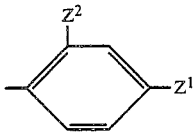 |
| 2 | 1 | 2 | $-NO_2$ | $-Cl$ | 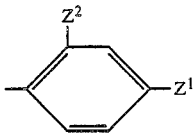 |
| 3 | 1 | 2 | $-Cl$ | $-H$ | 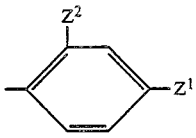 |
| 4 | 1 | 2 | $-NO_2$ | $-H$ | 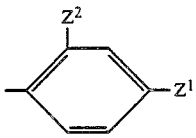 |
| 5 | 1 | 2 | $-SO_2CH_3$ | $-H$ | 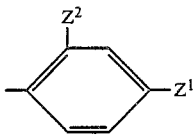 |

TABLE 3-continued
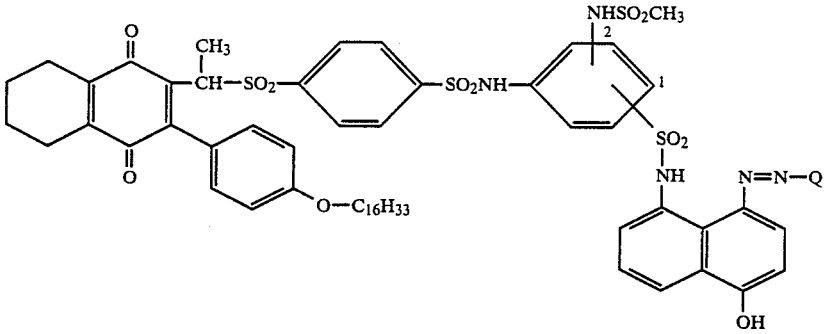
| No. | $-NHSO_2CH_3$ position | $-SO_2NH-$ position | $Z^1$ | $Z^2$ | Q |
|---|---|---|---|---|---|
| 6 | 1 | 2 | $-NO_2$ | $-SO_2CH_3$ | 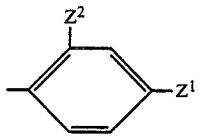 |
| 7 | 1 | 2 | $-CN$ | $-H$ | 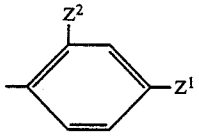 |
| 8 | 1 | 2 | — | — | 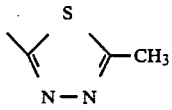 |
TABLE 4
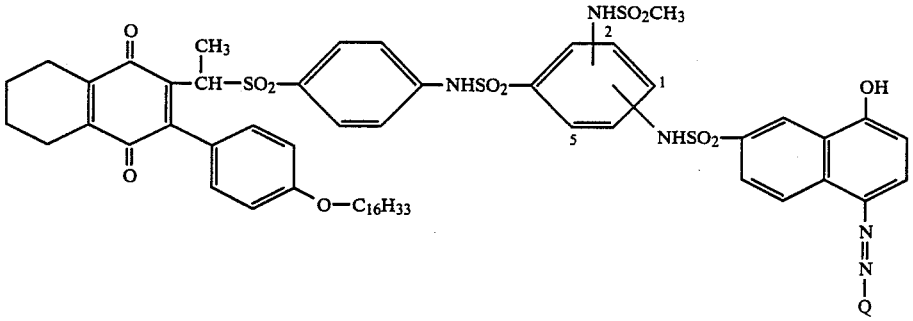
| No. | $-NHSO_2CH_3$ position | $-NHSO_2-$ position | $Z^1$ | $Z^2$ | Q |
|---|---|---|---|---|---|
| 1 | 5 | 2 | $-NO_2$ | $-SO_2CH_3$ | 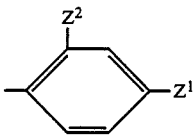 |
| 2 | 5 | 2 | $-NO_2$ | $-Cl$ | 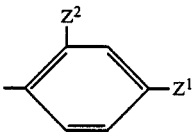 |
| 3 | 5 | 2 | $-Cl$ | $-H$ | 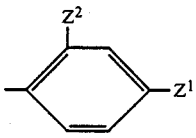 |

TABLE 4-continued
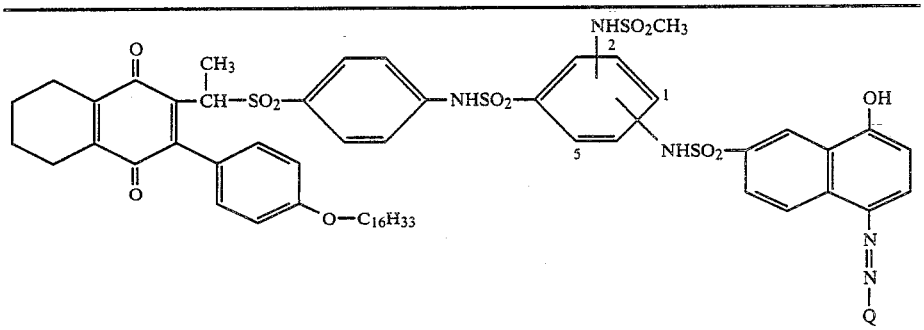
| No. | $-NHSO_2CH_3$ position | $-NHSO_2-$ position | $Z^1$ | $Z^2$ | Q |
|---|---|---|---|---|---|
| 4 | 5 | 2 | $-NO_2$ | $-H$ | 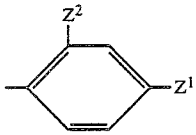 |
| 5 | 5 | 2 | $-SO_2CH_3$ | $-H$ | 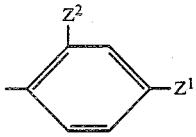 |
| 6 | 5 | 2 | $-CN$ | $-H$ | 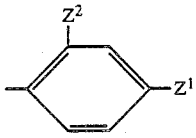 |
| 7 | 5 | 2 | — | — | 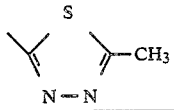 |
Preparation of compound 1 of Table 3
The preparation is illustrated by the following reaction scheme:
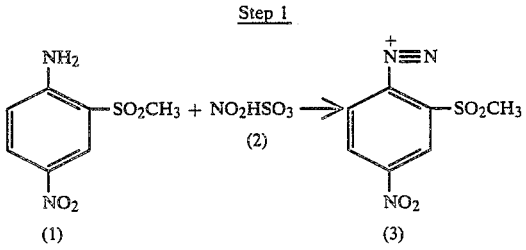
Compound (4):
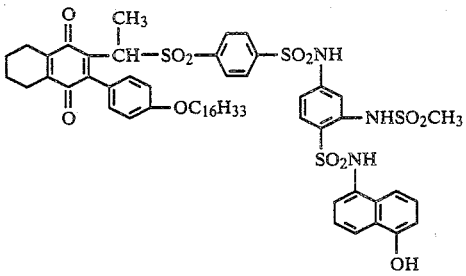
was prepared by the following intermediate step:
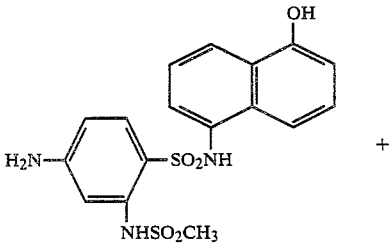

-continued

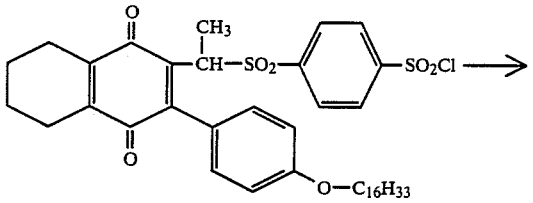

(6)

compound (4)

Compound (5) has been prepared analogously as described for compound (6) in EP-A No. 85201626.0 and U.S. patent application Ser. No. 916,932. Compound (6) has been prepared as described in published EP-A No. 0109701.

Step 1

2.1 g of compound (1) were dissolved in 13.4 ml of acetic acid and at 20° C. 1.5 ml of sulphuric acid were added. Thereupon while stirring 1.6 ml of $NO_2HSO_3$ (40% wt solution in $H_2SO_4$) were added at 15° C.

Step 2

While stirring to the reaction mixture of step 1 4 g of compound (4) dissolved in 21.4 ml of ethylene glycol monomethyl ether acetate were added at 5° C. Stirring was continued for 4 h at 5° C. and the reaction mixture was kept overnight. The crude product was precipitated by adding 160 ml of water and stirred for 1 h. By suction filtering 5.1 g of crude product were obtained that were purified by preparative column chromatography. Yield of compound 1 of Table 3: 2 g.

Intermediate step 3 g (0.00736 mole) of compound (5) were added to 6 g (0.0081 mole) of compound (6) in a mixture of 81 ml of acetone, 8 ml of water and 6.4 ml of pyridine.

The reaction mixture was stirred and boiled with reflux while a further quantity (29.4 g) of compound (6) was added to complete the reaction.

After the completion of the reaction which was followed by thin layer chromatography the reaction mixture was poured into 500 ml of water and the reaction product extracted with ethyl acetate. Thereupon the extract was washed two times with diluted hydrochloric acid and two times with an aqueous saturated sodium chloride solution. The extract was dried with $Na_2SO_4$ and the solvent evaporated. Yield: 4.2 g of (4).

Preparation of compound 6 of Table 3

The preparation is illustration by the following reaction scheme:

Step 1

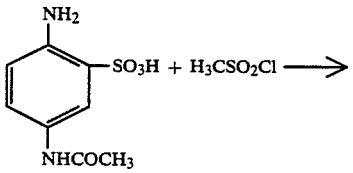

(1) (2)

-continued

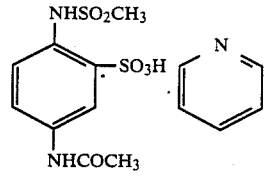

(3)

Step 2

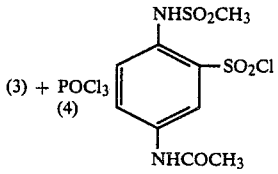

(5)

Step 3

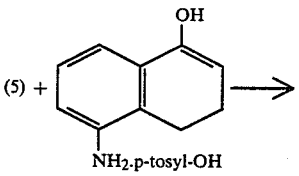

(6)

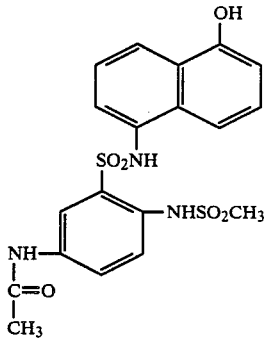

(7)

Step 4

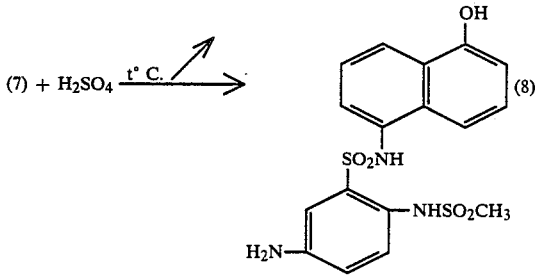

Step 5

-continued

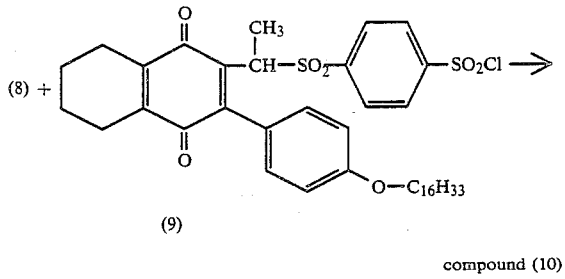

(9)

compound (10)

Compound 10:

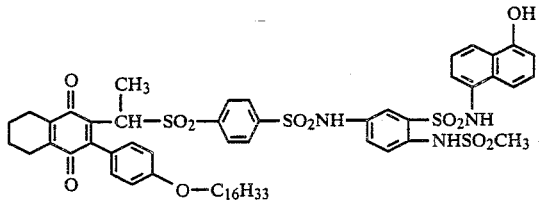

Step 6

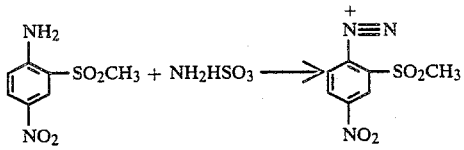

(11) (12) (13)

Step 7

(13) + (10) ⟶ compound 6 of Table 3

Step 1

80.5 g (0.35 mole) of compound (1) were added portion-wise at 5° C. to a mixture of 390 ml of pyridine and 54.3 ml of $CH_3SO_2Cl$. After stirring for 3 h at 10° C. the reaction was completed. The pyridine was evaporated and 5 times 200 ml of toluene were added and each time distilled off. Yield of crude compound (3): 226.1 g. Purification proceeded by preparative column chromatography.

Step 2

6.5 g of compound (3) were added slowly at 20° C. to 15 ml of $POCl_3$. In the temperature range of 15°-20° C. 2.8 ml of N-methylpyrrolidinone were added dropwise. Thereupon while stirring the reaction mixture was heated to 55° C. for 2 h. The reaction mixture was poured into 210 ml of methylene chloride, washed with ice-water and two times with 60 ml of a saturated sodium chloride solution. The organic phase was dried with $Na_2SO_4$ and partially evaporated and used as such in step 3.

Step 3

The product of step 2 was mixed with stirring at 10° C. with 8.8 g of compound (6), 25 ml of acetone and 2 ml of water. 9 ml of pyridine were added dropwise at 10°-20° C. The reaction mixture was kept overnight, treated with 300 ml of water and extracted three times with 250 ml of ethyl acetate. Thereupon the product was salted out by addition of sodium chloride, dissolved in ethyl acetate again and washed again. Finally the organic phase was dried with $Na_2SO_4$ and evaporated. Yield of crude compound (7): 9.9 g. Purification proceeded by preparative column chromatography.

Step 4

4.3 g of compound (7) was dissolved in a mixture of 18.5 ml of methoxypropanol, 18.5 ml of water and 1.3 ml of sulphuric acid. The reaction mixture was stirred and boiled with reflux for 2 h. Upon cooling the reaction mixture was poured into a mixture of 9 g of sodium acetate.3 $H_2O$ and 90 ml of ice-water. While stirring the product solidified. It was separated by filtering and dried. Yield: 3.7 g of compound (8).

Step 5

3.5 g of compound (8) and 8 g of compound (9) were added to 100 ml of acetone, 10 ml of water and 1.8 ml of pyridine. While stirring the reaction mixture was boiled with reflux for 2 h. Thereupon 1 ml of pyridine was added and a further quantity (1.6 g) of compound (9). The completion of the reaction was checked by thin layer chromatography.

The reaction mixture was cooled down and poured into 600 ml of wayter. The reaction product was extracted three times with 500 ml of ethyl acetate and salted out with sodium chloride. The organic solvent was removed, 14.5 g of crude compound (10) were obtained. Purification proceeded by preparative column chromatography.

Step 6

1.5 g (0.0067 mole) of compound (11) were dissolved in 20 ml of acetic acid. While stirring at 20° C. 1.3 ml of concentrated sulphuric acid was added and thereupon at 15° C. 1.3 ml of $NO_2HSO_3$ (40% wt solution in $H_2SO_4$) were added dropwise and stirred for 30 minutes at 15° C. The reaction mixture was used as such in step 7.

Step 7

The solution of diazonium compound (13) obtained in step 6 was added while stirring at 5° C. to 6 g of compound (10) in 35 ml of ethylene glycol monomethyl ether acetate.

The reaction mixture was kept overnight and poured while stirring into 110 ml of water.

The reaction product was separated by filtering, washed and dried.

Purification proceeded by preparative column chromatography. Yield: 6.2 g of compound 6 of Table 3.

The synthesis of the other compounds of Table 3 and of the compounds of Table 4 proceeds analogously using the proper dye part intermediates.

The compounds according to the present invention are suited for use in a dye diffusion transfer process and for that purpose are used in operative association with a light-sensitive silver halide emulsion layer, preferably of the negative-working type, i.e. of the type obtaining a silver image in the photo-exposed areas.

For dye image production a photographic silver halide emulsion material according to the present invention comprises a support carrying at least one alkali-permeable silver halide hydrophilic colloid emulsion layer having in operative association therewith a said dye releasing ballasted non-diffusing compound according to the present invention.

By "operative association38 is understood that the release of a diffusible dye moiety, e.g. azo dye, from the compound can proceed in function of the development of the silver halide emulsion layer. Therefore, the dye-releasing compound has not necessarily to be present in the silver halide emulsion layer but may be contained in another layer being in water-permeable relationship therewith.

In an embodiment for producing multicolour images this invention relates to a photographic material that comprises a support carrying (1) a red-sensitive silver halide emulsion layer having operatively associated therewith a dye-releasing compound that is initially immobile in an alkali-permeable colloid medium and wherefrom in function of the reducing action of a silver halide developing agent and alkalinity a cyan dye is split off in diffusible state, (2) a green-sensitive silver halide emulsion layer having operatively associated therewith another dye releasing compound with the difference that a magenta dye is split off in diffusible state, and (3) a blue-sensitive silver halide emulsion layer having operatively associated therewith still another dye releasing compound with the difference that a yellow dye is split off in diffusible state, at least one of said dye releasing compounds being one of the compounds according to the present invention as defined above.

In the present colour-providing compounds the dye group(s) may be associated with substituents that form a shifted dye.

Shifted dyes as mentioned, e.g., in U.S. Pat. No. 3,260,597 include those compounds wherein the light-absorption characteristics are shifted hypsochromically or bathochromically when subjected to a different environment such as a change of the $pK_a$ of the compound.

It has been established that the incorporation of the compounds corresponding to the general formula of Research Disclosure 24236 of June 1984, pages 275 to 278, in a silver halide emulsion layer of the negative type for use according to colour diffusion transfer reversal processes, may lead to a favourable fog-inhibition without retarding of the development. Examples of such compounds are 1-[meta(2-sulphobenzamido)-phenyl]-5-mercaptotetrazole, 1-(meta-carboxymethylthioacetamido)-phenyl-5-mercaptotetrazole and the sodium salt of 3-methyl-4-orthosulphobenzamido-5-thio-1H-1,2,4-triazole.

It is preferred to carry out the colour diffusion transfer process with the present coloured IHR-quinonoid compounds in conjunction with a mixture of reducing agents at least two of which being a compound called electron donor (ED-compound) and a compound called electron-transfer agent (ETA-compound) respectively.

The ED-compounds are preferably non-diffusing, e.g. are provided with a ballasting group, so that they remain within the layer unit wherein they have to transfer their electrons to the quinonoid compound.

The ED-compound is preferably present in non-diffusible state in each silver halide emulsion layer containing a different non-diffusible coloured IHR-quinonoid compound. Examples of such ED-compounds are ascorbyl palmitate and 2,5-bis(1',1',3',3'-tetramethylbutyl)hydroquinone. Other ED-compounds are disclosed in U.S. Pat. No. 4,139,379 and in published DE-A No. 2,947,425. Instead of an ED-compound an electron-donor precursor (EDP) compound can be used in the photographic material as described e.g. in published DE-A No. 2,809,716 and in U.S. Pat. No. 4,278,750. Particularly useful ED-precursor compounds for combination with the present IHR compounds are disclosed in published EP-A No. 0 124 915 and in published DE-A No. 3,006,268, which in the latter case correspond to the following general formula:

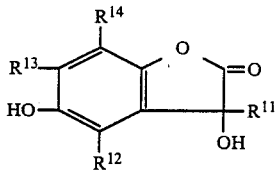

wherein:

$R^{11}$ represents a carbocyclic or heterocyclic aromatic ring, each of $R^{12}$, $R^{13}$ and $R^{14}$ (same or dfferent) represents hydrogen, alkyl, alkenyl, aryl, alkoxy, alkylthio, amino, or $R^{13}$ and $R^{14}$ together represent an adjacent ring, e.g. carbocyclic ring, at least one of $R^{11}$, $R^{12}$, $R^{13}$ and $R^{14}$ representing a ballast group having from 10 to 22 carbon atoms.

The ETA-compound is preferably used as developing agent in diffusible state and is, e.g., incorporated in mobile form in (a) hydrophilic colloid layer(s) adjacent to one or more silver halide emulsion layers or applied from the processing liquid for the dye diffusion transfer.

Typically useful ETA-compounds include hydroquinone compounds, aminophenol compounds, catechol compounds, phenylenediamines and 3-pyrazolidinone compounds e.g. 1-aryl-3-pyrazolidinone as defined, e.g., in U.S. Pat. No. 4,139,379.

A combination of different ETA's such as those disclosed in U.S. Pat. No. 3,039,869 can be employed likewise. Such developing agents can be used in the liquid processing composition or may be contained, at least in part, in any layer or layers of the photographic element or film unit such as the silver halide emulsion layers, the dye image-providing material layers, interlayers, image-receiving layer, etc. The particular ETA selected will, of course, depend on the particular electron donor and quinonoid compound used in the process and the processing conditions for the particular photographic element.

The concentration of ED-compound or ED-precursor compound in the photographic material may vary within a broad range but is, e.g., in the molar range of 1:1 to 8:1 with respect to the quinonoid compound. The ETA-compound may be present in the alkaline aqueous liquid used in the development step, but is used preferably in diffusible form in a non-sensitive hydrophilic colloid layer adjacent to at least one silver halide emulsion layer.

Migration of non-oxidized developing agent, e.g. acting as ETA-compound, proceeds non-image-wise and has an adverse effect on correct colour rendering when surplus developing agent remains unoxidized in the photoexposed areas of a negative-working emulsion layer. Therefore, according to a preferred embodiment of the present invention a silver halide solvent, e.g. thiosulphate, is used to mobilize unexposed silver halide in complexed form for helping to neutralize (i.e. oxidize by physical development) migrated developing agent in the photoexposed areas wherein unaffected developing agent (ETA-compound) should no longer be available for reacting with the quinonoid compound directly or through the applied ED-compound. The use of silver halide solvents for that purpose has been described in the published EP-A No. 0049002.

In order to obtain a better colour rendition it is also advantageous to intercept oxidized ETA-compound and to prevent it from migrating to adjacent imaging layers where it could cause the undesired oxidation of ED-compound. For said interception so-called scavengers are used that are incorporated in the photographic material in non-diffusible state, e.g. in interlayers between the imaging layers. Suitable scavengers for that purpose are described, e.g., in U.S. Pat. No. 4,205,987 and published EP-A No. 0,029,546.

The present dye releasing compounds and optionally ED or EDP-compounds can be incorporated in the photographic material by addition to the coating liquid(s) of its layer(s) by the usual methods known, e.g., for the incorporation of colour couplers in photographic silver halide emulsion materials.

The amount of dye-releasing compound coated per sq.m may vary within wide limits and depends on the maximum colour density desired.

The photographic material may contain (a) filter layer(s) to improve the correct spectral exposure of the differently spectrally sensitive silver halide emulsion layers, e.g. a yellow (colloidal silver) layer below the only blue-sensitive silver halide emulsion layer and a magenta filter layer below the green-sensitive silver halide emulsion layer absorbing green light whereto the underlying red-sensitized silver halide emulsion layer may be sensitive to some extent. A suitable magenta dye for that purpose is Violet Quindo RV 6911-Colour index, C.I 46500 Pigment Violet 19.

The support for the photographic elements of this invention may be any material as long as it does not deleteriously affect the photographic properties of the film unit and is dimensionally stable. Typical flexible sheet materials are paper supports, e.g. coated at one or both sides with an Alpha-olefin polymer, e.g. polyethylene; they include cellulose nitrate film, cellulose acetate film, poly(vinyl acetal) film, polystyrene film, poly(ethylene terephthalate) film, polycarbonate film, poly-Alpha-olefins such as polyethylene and polypropylene film, and related films or resinous materials. The support is usually about 0.05 to 0.15 mm thick.

The image-receiving layer can form part of a separate image-receiving material or form an integral combination with the light-sensitive layer(s) of the photographic material.

Where the image-receiving layer after processing of the photosensitive material remains associated with the silver halide emulsion layer(s) normally an alkali-permeable light-shielding layer, e.g. containing white pigment particles is applied between the image-receiving layer and the silver halide emulsion layer(s).

For use in dye diffusion transfer photography any material may be employed as the image-receiving layer as long as the desired function of mordanting or otherwise fixing the diffused dye will be obtained. The particular material chosen will, of course, depend upon the dye to be mordanted. If acid dyes are to be mordanted, the image-receiving layer may be composed of or contain basic polymeric mordants such as polymers of amino-guanidine derivatives of vinyl methyl ketone such as described in U.S. Pat. No. 2,882,156 of Louis M. Minsk, issued Apr. 14, 1959, and basic polymeric mordants and derivatives, e.g. poly-4-vinylpyridine, the metho-p-toluene sulphonate of 2-vinylpyridine and similar compounds described in U.S. Pat. No. 2,484,430 of Robert H. Sprague and Leslie G. Brooker, issued Oct. 11, 1949, and the compounds described in the published DE-A No. 2,200,063 filed Jan. 11, 1971 by Agfa-Gevaert A.G. Suitable mordanting binders include, e.g., guanylhydrazone derivatives of acyl styrene polymers, as described, e.g., in published DE-A No. 2,009,498 filed Feb. 28, 1970 by Agfa-Gevaert A.G. In general, however, other binders, e.g. gelatin, would be added to the last-mentioned mordanting binders. Effective mordanting compositions are long-chain quaternary ammonium or phosphonium compounds or ternary sulphonium compounds, e.g. those described in U.S. Pat. Nos. 3,271,147 of Walter M. Bush and 3,271,148 of Keith E. Whitmore, both issued Sept. 6, 1966, and cetyltrimethyl-ammonium bromide. Certain metal salts and their hydroxides that form sparingly soluble compounds with the acid dyes may be used too. The dye mordants are dispersed in one of the usual hydrophilic binders in the image-receiving layer, e.g. in gelatin, polyvinylpyrrolidone or partly or completely hydrolysed cellulose esters.

Generally, good results are obtained when the image-receiving layer, which is preferably permeable to alkaline solution, is transparent and about 4 to about 10 μm thick. This thickness, of course, can be modified depending upon the result desired. The image-receiving layer may also contain ultraviolet-adsorbing materials to protect the mordanted dye images from fading, brightening agents such as the stilbenes, coumarins, triazines, oxazoles, dye stabilizers such as the chromanols, alkyl-phenols, etc.

Use of pH-lowering material in the dye-image-receiving element will usually increase the stability of the transferred image. Generally, the pH-lowering material will effect a reduction of the pH of the image layer from about 13 to 14 to at least 11 and preferably 5 to 7 within a short time after imbibition. E.g., polymeric acids as disclosed in U.S. Pat. No. 3,362,819 of Edwin H. Land, issued Jan. 9, 1968, or solid acids or metal salts, e.g. zinc acetate, zinc sulphate, magnesium acetate, etc., as disclosed in U.S. Pat. No. 2,584,030 of Edwin H. Land, issued Jan. 29, 1952, may be employed with good results. Such pH-lowering materials reduce the pH of the film unit after development to terminate development and substantially reduce further dye transfer and thus stabilize the dye image.

An inert timing or spacer layer may be employed over the pH-lowering layer, which "times" or controls the pH reduction depending on the rate at which alkali diffuses through the inert spacer layer. Examples of such timing layers include gelatin, polyvinyl alcohol or any of the colloids disclosed in U.S. Pat. No. 3,455,686 of Leonard C. Farney, Howard G. Rogers and Richard W. Young, issued July 15, 1969. The timing layer may be effective in evening out the various reaction rates over a wide range of temperatures, e.g., premature pH reduction is prevented when imbibition is effected at temperatures above room temperature, e.g. at 35° to 37° C. The timing layer is usually about 2.5 μm to about 18 μm thick. Especially good results are obtained if the timing layer comprises a hydrolysable polymer or a mixture of such polymers that are slowly hydrolysed by the processing composition. Examples of such hydrolysable polymers include polyvinyl acetate, polyamides, cellulose esters, etc.

An alkaline processing composition employed in the production of dye images according to the present invention may be a conventional aqueous solution of an alkaline material, e.g. sodium hydroxide, sodium carbonate or an amine such as diethylamine, preferably possessing a pH beyond 11.

According to one embodiment the alkaline processing liquid contains the diffusible developing agent that effects the reduction of the silver halide, e.g. ascorbic acid or a 3-pyrazolidinone developing agent such as 1-phenyl-4-methyl-3-pyrazolidinone.

The alkaline processing composition employed in this invention may also contain a desensitizing agent such as methylene blue, nitro-substituted heterocyclic compounds, 4,4'-bipyridinium salts, etc., to insure that the photosensitive element is not further exposed after its removal from the camera for processing.

For in-camera-processing, the solution also preferably contains a viscosity-increasing compound such as a high-molecular-weight polymer, e.g. a water-soluble ether inert to alkaline solutions such as hydroxyethylcellulose or alkali metal salts of carboxymethycellulose such as sodium carboxymethylcellulose. A concentration of viscosity-increasing compound of about 1 to about 5% by weight of the processing composition is preferred. It imparts thereto a viscosity of about 100 mPa.s to about 200,000 mPa.s.

Although the common purpose in the known-dye diffusion transfer systems is the production of dye images in a receiving layer or sheet whereby the released dye(s) are eliminated from the photosensitive element by diffusion transfer, a residual image of dye may be likwise of practical interest forming a so-called "retained image". The latter terminology is used, e.g., in Research Disclosure (No. 17362) of September 1978 and a dye-diffusion process relating thereto is exemplified in Research Disclosure (No. 22711) of March 1983.

Processing may proceed in a tray developing unit as is contained, e.g., in an ordinary silver complex diffusion transfer (DTR) apparatus in which contacting with a separate dye image-receiving material is effected after a sufficient absorption of processing liquid by the photographic material has taken place. A suitable apparatus for said purpose is the COPYPROOF CP 38 (trade name) DTR-developing apparatus. COPYPROOF is a trade name of Agfa-Gevaert, Antwerp/Leverkusen.

According to an embodiment wherein the image-receiving layer is integral with the photosensitive layer(s), the processing liquid is applied from a rupturable container or by spraying.

A rupturable container that may be employed is e.g. of the type disclosed in U.S. Pat. Nos. 2,543,181 of Edwin H. Land, issued Feb. 27, 1951, 2,643,886 of Ulrich L. di Ghilini, issued June 30, 1953, 2,653,732 of Edwin H. Land, issued Sept. 29, 1953, 2,723,051 of William J. McCune Jr., issued Nov. 8, 1955, 3,056,492 and 3,056,491, both of John E. Campbell, issued Oct. 2, 1962, and 3,152,515 of Edwin H. Land, issued Oct. 13, 1964. In general, such containers comprise a rectangular sheet of fluid- and air-impervious material folded longitudinally upon itself to form two walls that are sealed to one another along their longitudinal and end margins to form a cavity in which processing solution is contained.

The following example further illustrates the present invention.

All percentages and ratios are by weight, unless otherwise mentioned, and the amounts are expressed per sq.m.

EXAMPLE

Preparation of photographic material

A subbed polyethylene terephthalate support having a thickness of 0.1 mm was coated in the mentioned order with the following layers:

(1) a silver halide emulsion layer containing:
gelatin: 2.1 g
AgCl expressed as $AgNO_3$: 0.6 g
an IHR-compound of Table 3: 0.343 g
ED compound: 2,5-bis(1',1',3',3'-tetramethylbutyl)-hydroquinone: 0.2 g (2) protective layer container: 0.2 g
gelatin: 3.3 g
1-phenyl-4-methyl-pyrazolidin-3-one: 0.12 g
citric acid up to a pH of 4.5 in the two layers: 0.06 g Other dye releasing compounds indicated in Table X were coated in the same way using the same molar amount.

The processing was carried out in a COPYPROOF (registered trade name of Agfa-Gevaert N.V. Belgium) T42 diffusion transfer processing apparatus containing in its tray an aqueous solution comprising per liter:
sodium hydroxide: 25 g
sodium orthophosphate: 25 g
cyclohexane dimethanol: 80 g sodium bromide: 2 g
sodium thiosulphate: 2 g
water up to: 1 liter.

After being wetted at room temperature (20° C.) with said solution the exposed photographic materials were contacted for 1 min with the receptor material as described hereinafter to allow the diffusion transfer of the dyes. After separating the photographic materials from the receptor material dye transfer was measured with a MACBETH (trade name) densitometer RD-919 in the Status A modus. Preparation of the dye receptor material To a corona-treated polyethylene coated support a coating having the following composition was applied per sq.m:

(1) gelatin: 2.5 g
polymeric mordanting agent prepared from 4,4'-diphenylmethane diisocyanate and N-ethyldiethanolamine quaternized with epichlorohydrine according to published German Patent Application (DE-OS) No. 2,631,521 Example 1: 2.5 g (2) protective gelatin layer: 0.8 g The stability against light was tested with a XENOTEST (trade name) type 50 apparatus of Hanau Quartzlampen GmbH, Hanau, W. Germany wherein the material was exposed with white light for 8 h. The % loss in maximum density of transferred dye is mentioned in Table 5.

TABLE 8

| Compound | % loss in maximum density |
|---|---|
| Compound 1 of Table 3 | −24 |
| Compound 6 of Table 3 | −20 |
| Comparsion compound C | −32 |

Comparison compound C has the same structure as compound 6 of Table 3 with the provision that the substituent: $—NHSO_2CH_3$ is replaced by H.

We claim:

1. A photographic silver halide emulsion material for dye image production comprising a support carrying at least one alkali-permeable silver halide hydrophilic colloid emulsion layer having in operative association therewith a dye releasing ballasted non-diffusing compound corresponding to the following general formula:

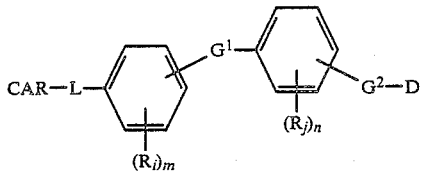

(I)

wherein:

CAR represents a ballasted carrier moiety making said compound non-diffusing in a hydrophilic colloid medium under wet alkaline conditions, L is —O—, —S—, —$SO_2$—, —$NR^1CO$—, —$NR^1$— or a —$N^+R^1R^2$—.($X^-$) group, wherein $R^1$ and $R^2$ (being the same or different when both are present) is hydrogen, an alkyl group or an aryl group, and $X^-$ is an anion, $G^1$, and $G^2$ (being the same or different) is a chemical bond or —O—, —S—, —$SO_2$—, —$CH_2$—, —$CH_2CH_2$—, —$NR^3$—, —$OCH_2CH_2O$—, —$OCH_2CH_2$—, —$CONR^3$—, $SO_2NR^3$—, —$NR^3CO$—, or —$NR^3SO_2$—, wherein $R^3$ is hydrogen, an alkyl group or an aryl group, D is an azo dye part chemically linked to $G^2$ there being only one bivalent aromatic nucleus of said dye part between an azo dye chromophore (—N=N—) of said dye part and the group $G^2$, $R_i$ and $R_j$ (being the same or different) is hydrogen or halogen, an alkyl group, alkoxy, alkylthio, a $R^4CONH$— group, or an $R^4SO_2NH$— group, wherein $R^4$ is an alkyl group, and m and n (being the same or different) is zero or 1, 2, 3 or 4 with the proviso that both m and n are not zero at the same time, and that at least the one of the groups $R_i$ and $R_j$ which is present, if both are not present, is the group $R^4SO_2NH$—.

2. A photographic material according to claim 1, wherein CAR is a hydroquinone or quinone type residue.

3. A photographic material according to claim 1, wherein said material comprises a support carrying red-, green- and blue-sensitive silver halide emulsion layers at least of which has operatively associated therewith a said dye-releasing compound.

4. A photographic material according to claim 1, wherein said photographic material contains in each silver halide emulsion layer a non-diffusible electron donor compound or electron donor precursor compound.

5. A photographic material according to claim 1, wherein said photographic material contains (a) silver halide emulsion layer(s) of the negative-working type.

6. A photographic material according to claim 1, wherein said compound is within the scope of one of the following general formulae (II) and (III):

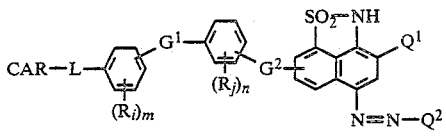

(II)

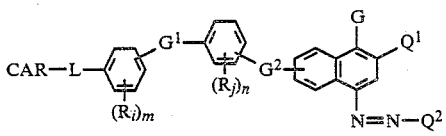

(III)

wherein:

G is OH or a hydrolysable precursor thereof, —$NH_2$, —$NHSO_2R^{10}$, —$NHCOR^{10}$ wherein $R^{10}$ has the same meaning as $R^1$ defined in claim 8, $Q^1$ is hydrogen, $SO_3H$, $CO_2H$, hydrolysable derivatives thereof or salts thereof, —$CONR^{11}R^{12}$, —$SO_2NR^{11}R^{12}$, —$COR^{13}$, or —$SO_2R^{13}$ with the proviso that $R^{11}$ and $R^{12}$ have one of the meanings given for $R^3$ in claim 8 and together may form a heterocyclic ring and that $R^{13}$ has one of the meanings given for $R^3$ in claim 8, $Q^2$ is an aryl group or a heterocyclic aromatic group, and wherein all the other symbols have the meaning described in general formula (I) of claim 8 but $G^2$ is present in general formula (II) in the 5-, 6- or 7-position of the naphthalene nucleus and in general formula (III) in the 5-, 6-, 7- or 8-position of the naphthalene nucleus carrying —N=N—$Q^2$ in the 4-position.

* * * * *